US005104232A

United States Patent [19]

Lennox, III

[11] Patent Number: 5,104,232

[45] Date of Patent: Apr. 14, 1992

[54] VANE AND CHILLING SYSTEMS FOR TUMBLE MIXERS

[75] Inventor: John M. Lennox, III, Sebastopol, Calif.

[73] Assignee: Blentech Corporation, Rohnert Park, Calif.

[21] Appl. No.: 609,884

[22] Filed: Nov. 6, 1990

Related U.S. Application Data

[63] Continuation-in-part of Ser. No. 447,198, Dec. 7, 1989, abandoned, which is a continuation-in-part of Ser. No. 304,966, Jan. 30, 1989, abandoned.

[51] Int. Cl.[5] ..... B01F 9/02

[52] U.S. Cl. ..... 366/227; 99/472; 99/487; 99/517; 62/68; 62/231; 62/388; 366/139; 366/147; 366/175; 366/187; 366/228; 366/233; 366/320

[58] Field of Search ..... 366/44, 52, 54, 56, 366/57, 59, 139, 187, 208, 213, 220, 225, 227–231, 233, 144, 339, 106, 167, 147, 175; 99/467, 472, 477, 478, 479, 516, 487, 517; 68/144, 146; 62/10, 68, 69, 70, 388, 231, 52.1, 342, 343, 373, 379, 384

[56] References Cited

U.S. PATENT DOCUMENTS

| | | | |
|---|---|---|---|
| Re. 23,320 | 1/1951 | Willard et al. | 366/44 |
| 44,704 | 10/1864 | Burns | 366/227 |
| 1,867,838 | 7/1932 | Jaeger | 366/44 |
| 2,048,657 | 7/1936 | Jaeger | 366/44 X |
| 2,399,679 | 5/1946 | Jackson | 62/231 |
| 2,879,005 | 3/1959 | Jarvis | 62/374 X |
| 2,883,166 | 4/1959 | Hilkemeier | 366/44 |
| 2,893,216 | 7/1959 | Seefeldt et al. | 62/384 X |
| 3,025,680 | 3/1962 | DeBrosse et al. | 62/231 X |
| 3,214,928 | 11/1965 | Oberdorfer | 62/374 X |
| 3,660,985 | 5/1972 | Tyree, Jr. | 366/144 X |
| 3,906,743 | 9/1975 | Schorsch et al. | 62/374 |
| 3,992,985 | 11/1976 | McFarland | 366/139 X |
| 4,187,325 | 2/1980 | Tyree, Jr. | 62/373 X |
| 4,314,451 | 2/1982 | Leeds et al. | 62/342 X |
| 4,476,686 | 10/1984 | Madsen et al. | 366/147 X |
| 4,517,888 | 5/1985 | Gould | 366/139 X |
| 4,640,099 | 2/1987 | Gibot | 62/68 X |
| 4,791,705 | 12/1988 | Corominas | 99/472 X |
| 4,828,397 | 5/1989 | Egretier | 366/187 X |
| 4,941,132 | 7/1990 | Horn et al. | 366/320 X |
| 4,994,294 | 2/1991 | Gould | 366/227 X |

*Primary Examiner*—Harvey C. Hornsby
*Assistant Examiner*—C. Cooley
*Attorney, Agent, or Firm*—Phillips, Moore, Lempio & Finley

[57] ABSTRACT

An improved vacuum tumble mixer (10) is provided, the mixer having a horizontal drum (11) with a cylindrical mid-section (12), frusto-conical or dished entry and discharge ends (13, 14), and entry and discharge openings (16, 17) axially into the ends, the drum (11) being rotatable in one direction to tumble products therein and rotatable in the other direction to discharge the contents from the dischage opening. A plurality of primary vanes (26) are secured helically to the interior of the mid-section (12) of the drum, the primary vanes having radial tumbling surfaces (27) to tumble the product and to move the product gently towards the entry end of the drum, the vanes (26) having opposed channel-shaped discharge surfaces (28) which progressively increase in height to convey the products in the drum to discharge chutes (31) that extend helically along the discharge end (14) of the drum to the discharge opening (17). A chilling system (50) can be provided with one or more $CO_2$ snowhorns (61) positioned at one of the ends (13, 14) to discharge $CO_2$ snow into the rotating drum (11) for mixing with the products after vacuum tumbling. The $CO_2$ snow is produced in repeated bursts with the on-and-off time of the repeated bursts being chosen to match the rate of production of $CO_2$ snow to the rate such snow can be mixed with the product.

13 Claims, 6 Drawing Sheets

VANE AND CHILLING SYSTEMS FOR TUMBLE MIXERS

RELATED APPLICATION

This application is a continuation-in-part of application Ser. No. 07/447,198, filed Dec. 7, 1989, now abandoned, which in turn was a continuation-in-part of application Ser. No. 07/304,966, filed Jan. 30, 1989, now abandoned.

BACKGROUND OF THE INVENTION

This invention relates to food mixing machines, more particularly to a vane system for drum-type tumble mixers operable under vacuum conditions and a chilling system for such machines.

Various meat products are tumbled under vacuum to improve the quality of the product. For example, poultry and ham are tumbled under full vacuum for approximately one hour to cause the product to absorb approximately 5-10% water and seasonings. The process makes the meat juicier, tenderer and more flavorful.

Drum tumble mixers for this purpose have much the same shape as concrete mixers but are designed to hold a full vacuum. Depending on the manufacturer, these drums have internal vanes approximately three to eight inches in height which, when the drum rotates, cause the produce to be lifted up with the vanes, with the product then spilling over the vanes. Since the product and water fill the drum about half full, the product will undergo a massaging action as the drum rotates. Thus, the product will be pressured and compressed as it is pushed ahead of the vanes, with the pressure being released as the product spills over the vanes. The compression of the product will squeeze air therefrom, while the release of pressure will allow the water and seasonings to be absorbed into the product. The effectiveness of the massaging depends on the height of the vanes and the level of vacuum. The higher the vanes, the more pressure is built up before the product flows over the tops of the vanes. The vane height, however, must be limited, since too high a vane will cause damage to the product, thus increasing waste. The higher the vacuum, the less reabsorption of air there will be when the pressure on the product is released.

Drum tumble mixers typically do not mix the product effectively from one end of the drum to the other. Most tumblers have vanes which are essentially parallel with the axis of the drum. Thus, the product rolls in a direction essentially perpendicular to the axis of rotation of the drum. When ingredients are added at the door on one end, they stay unmixed at that end. For this reason, the processor must often either pre-mix, or mix after vacuum tumbling. Neither alternative is acceptable, because extra mixing deteriorates and bruises the product and/or works air back into the product.

Rapid discharge is also critical since tumbling of the product after the vacuum is released will work air back into the product, thereby reducing quality. Vane configuration is critical to rapid discharge since the vanes massage the product when the drum is rotated in one direction and convey the product out the discharge door when the drum is rotated in the opposite direction.

The ideal tumble mixer is one which: (1) provides the optimum pressure fluctuations on the product as it is compressed and then tumbles over the vanes; (2) mixes the product completely from end to end in the tumbler drum, and; (3) discharges the product quickly from the drum when the vacuum is released and the discharge door is opened.

There are two basic types of vane systems presently used in vacuum tumblers: (1) spiral vanes, and; (2) parallel vanes. The spiral vane system uses a single vane which makes approximately two full rotations in the length of the tumbler drum. The parallel system has a multiple of vanes which are nearly parallel to the drum axis, but at a slight angle so as to provide a minimal conveying the product towards the discharge end of the drum when its rotation is reversed for discharge.

The main advantages of the spiral vane system are that, (1) it has a very fast discharge since the vane acts as a screw conveyor when the tumbler is reversed for discharge, and (2) it provides a very good end-to-end mixing of the product since the spiral vane tends to convey the product end-to-end during tumbling, causing it to flow end-to-end over itself. On the other hand, the spiral vane provides very poor massaging action since much of the product may slide along the vane instead of being compressed by the vane and then spilling thereover.

The parallel vane system has the opposite advantages and disadvantages. The pressure-pulsing massage is very good since there is very little movement of the product lengthwise of the tumbler during movement of the vanes. However, the limited movement of the product lengthwise of the drum results in poor end-to-end mixing. The vacuum tumbler will discharge fairly rapidly from its single discharge trough when the tumbler is nearly full. However, when the tumbler approaches one quarter full, the rate of discharge is reduced dramatically because the discharge trough can only pick up the product that has finally reached the discharge end of the drum. The slow end-to-end movement of the product caused by the vanes thus requires substantial time to move the remainder of the product into position for discharge.

In the processing of most meat and poultry products, it is desirable to chill the product after vacuum tumbling. In the past, when a food product has been processed in a tumble mixer, it has been necessary to remove the product from the vacuum tumbler and convey it into a twin agitator blender equipped with $CO_2$ (carbon dioxide) snowhorns. A $CO_2$ snowhorn is a cylindrical tube, open at one end and closed at the other, with a liquid $CO_2$ injection nozzle in the closed end. Liquid $CO_2$ is injected and swirled inside the tubular horn, causing it to turn into $CO_2$ snow. This snow is ejected from the horn into the blender chamber and is mixed with the product. As the snow sublimates into gas, it chills the product in which it has been mixed.

The present chilling systems have several significant problems. First of all, the need to transfer the product from the vacuum tumbler to the blending machine requires more time in the processing of the product. Secondly, the $CO_2$ blenders in use today may cause considerable damage to the meat fibers of the poultry products, particularly when the product is chilled.

As a consequence, there is a need to provide a way to chill the product quickly and with a minimum of mechanical damage to the product.

Two factors must be taken into consideration in determining the cost of chilling a product, namely the efficiency of generation of $CO_2$ snow and the efficiency of mixing the $CO_2$ with the product that is to be chilled. Liquid $CO_2$ is very expensive and it is very desirable to use the least amount of liquid $CO_2$ to provide the desired amount of chilling.

As is well known in the art, there is a combination of snowhorn diameter, length, orifice diameter, number of orifices and rate of flow of liquid $CO_2$ to the snowhorn that will convert liquid $CO_2$ into $CO_2$ snow most efficiently. If one of these parameters is changed without adjusting the other parameters, the snow generating efficiency of the horn will be reduced. That is, the number of ounces of snow that can be generated from pound of liquid $CO_2$ will be decreased, and the cost of chilling will be increased.

From the moment that $CO_2$ snow is formed, it will begin to change into a gas. This change of state from a solid snow to a gas requires significant heat; thus, products with which the snow is in contact are chilled. If the snow is not evenly mixed with the product as it changes state, it will unevenly chill the product. If the snow is being generated at a greater rate than the snow can be mixed into the product, the excess snow will merely chill the air around the product as it subliminates, and the chilled air will be pushed out of the $CO_2$ discharge vent without an effective chilling of the product.

The efficiency of mixing the $CO_2$ snow into the product depends on the design of the mixer—the vane design in the case of a tumbler, or the agitator design in a blender. The mixing efficiency also depends on the nature of the product being blended. This presents a very difficult engineering and food processing problem. The design of an efficient snowhorn system cannot be readily changed to adjust the rate of snow generation to the rate at which the snow can be mixed with the product without adversely affecting the efficiency of the snowhorn. In addition, the easiest parameter that can be changed is the orifice, but the changing of the orifice takes considerable time and the result is difficult to anticipate. Thus, this becomes a trial-and-error process. Likewise, it may be very difficult or impracticable to change the efficiency of mixing so that all of the produced snow is mixed with the product. For example, the efficiency of mixing could be increased by rotating the tumbler drum or agitator vanes at a higher speed. However, this may increase the damage to the product to an unacceptable level.

As a consequence there is a need to provide a way of producing $CO_2$ snow with high efficiency and with the rate of production being matched to the rate at which the snow can be efficiently mixed with the product.

SUMMARY OF THE INVENTION

It is the primary object of the invention to provide a vacuum tumble mixer with a vane system which has the advantage of the parallel vane system plus the advantages of the spiral vane system, i.e., good pressure-pulsing massage, good end-to-end mixing and rapid discharge.

It is a further object of the invention to provide a vacuum tumble mixer with a vane system as set forth in the previous paragraph and with a chilling system for chilling products within the vacuum tumble mixer.

It is further object of the invention to provide a chilling system for a food mixer wherein the rate of high-efficiency production of $CO_2$ snow may be easily matched to the rate of efficient mixing of the mixer.

Additional objects, advantages and novel features will be set forth in the description which follows, and in part will become apparent to those skilled in the art upon examination of the following, or may be learned by practice of the invention. The objects and advantages of the invention may be realized and attained by means of the instrumentalities and combinations pointed out in the appended claims.

To achieve the foregoing and other objects, and in accordance with the present invention, as described and broadly claimed herein, an improved vacuum tumble mixer is provided having a drum with a cylindrical mid-section and frusto-conical or dished entry and discharge ends and a plurality of helical vanes, spaced equidistantly apart and extending along the mid-section from one end to the other, the vanes having tumbling surfaces facing in a direction towards the entry end for providing tumbling and end-to-end mixing as the drum rotates in a tumbling direction, the vanes having opposite discharge surfaces facing in a direction towards the discharge end, the discharge surfaces increasing progressively in height towards the discharge end and merging smoothly with discharge troughs helically disposed on the discharge end of the drum.

A further aspect of the invention is that one or more additional helical vanes, depending on the drum diameter, can be provided on the mid-section of the drum from one end to the other and between the main vanes, all vanes in the drum being equally spaced from each other, the additional vanes having a constant cross-section throughout their length, the additional vanes providing increased tumbling, end-to-end mixing during tumbling and conveying to the discharge end during discharge rotation of the drum.

A yet further aspect of the invention is that a fixed plate is removably positioned against one end of the rotatable drum, the plate having a $CO_2$ snowhorn mounted thereon for supplying $CO_2$ snow to the drum and an exhaust vent for venting $CO_2$ gas from the drum as it rotates.

It is a still further aspect of the invention to match the rate of production of $CO_2$ snow to the mixing efficiency of the mixer by supplying liquid $CO_2$ to the snowhorn in repeated cycles with the liquid $CO_2$ being supplied to the snowhorn for a predetermined length of time during each cycle.

BRIEF DESCRIPTION OF THE DRAWINGS

The accompanying drawings, which are incorporated in and form part of the application, together with the description, serve to explain the principles of the invention.

DESCRIPTION OF THE PREFERRED EMBODIMENT

Figure 1:
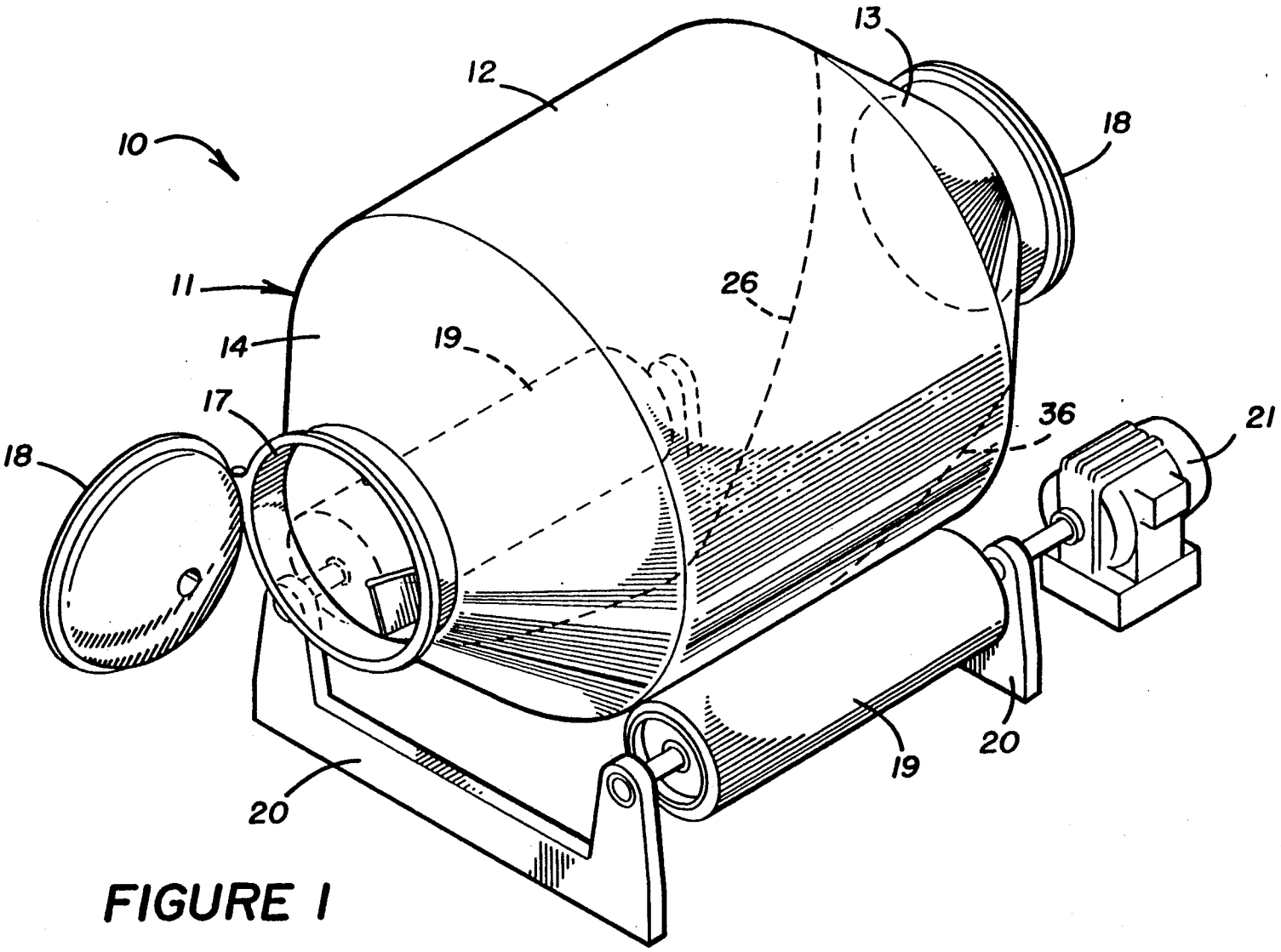
FIG. 1 is a simplified perspective view of a vacuum tumble mixer with an internal vane system in accordance with the present invention, some of the vanes being indicated in phantom on the tumbler drum.
Figure 2:
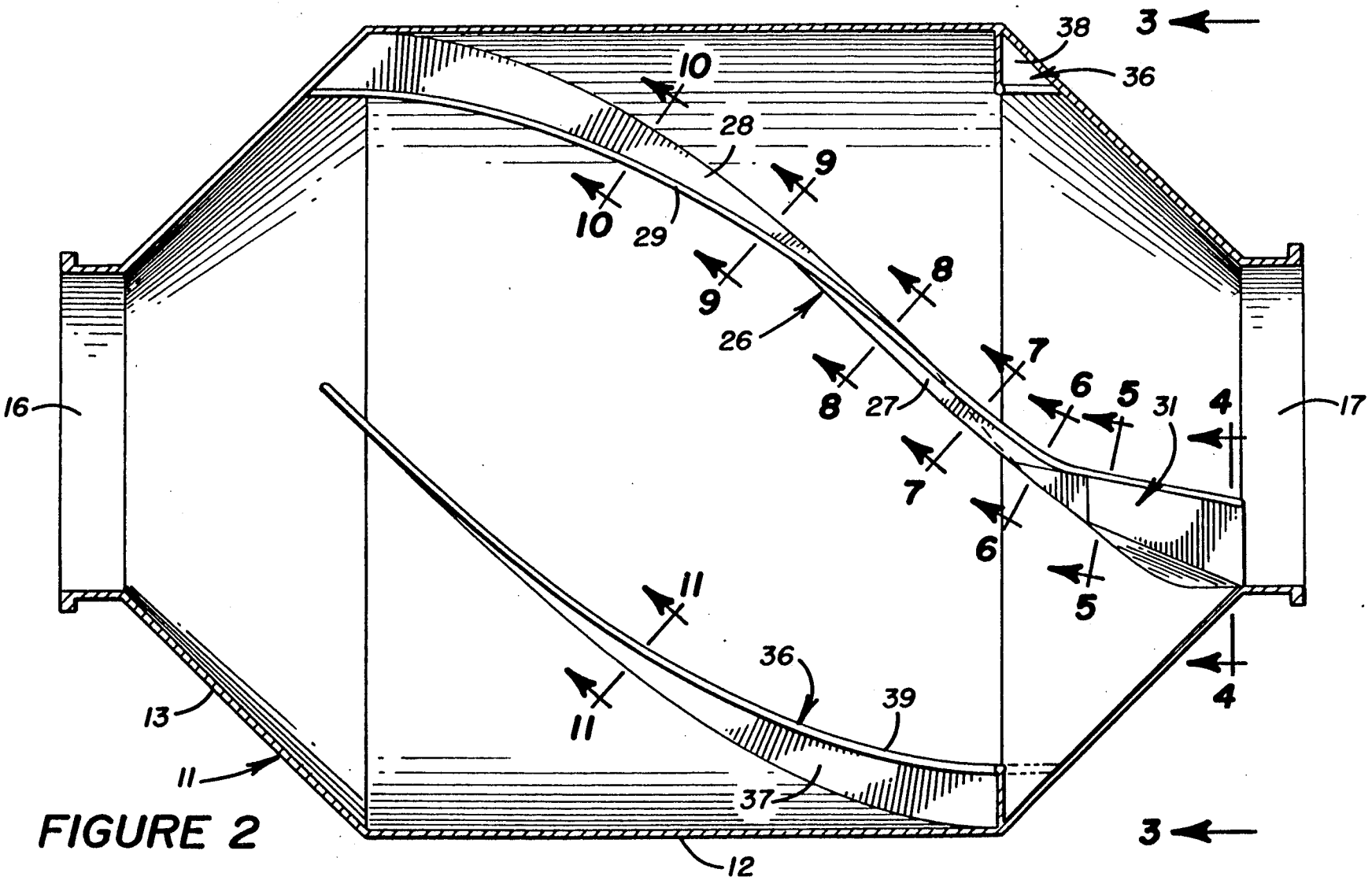
FIG. 2 is a vertical sectional view of the tumble mixer of FIG. 1, taken along the axis of rotation thereof.
Figures 3, 4, 5, 6, 7, 8, 9, 10, 11:
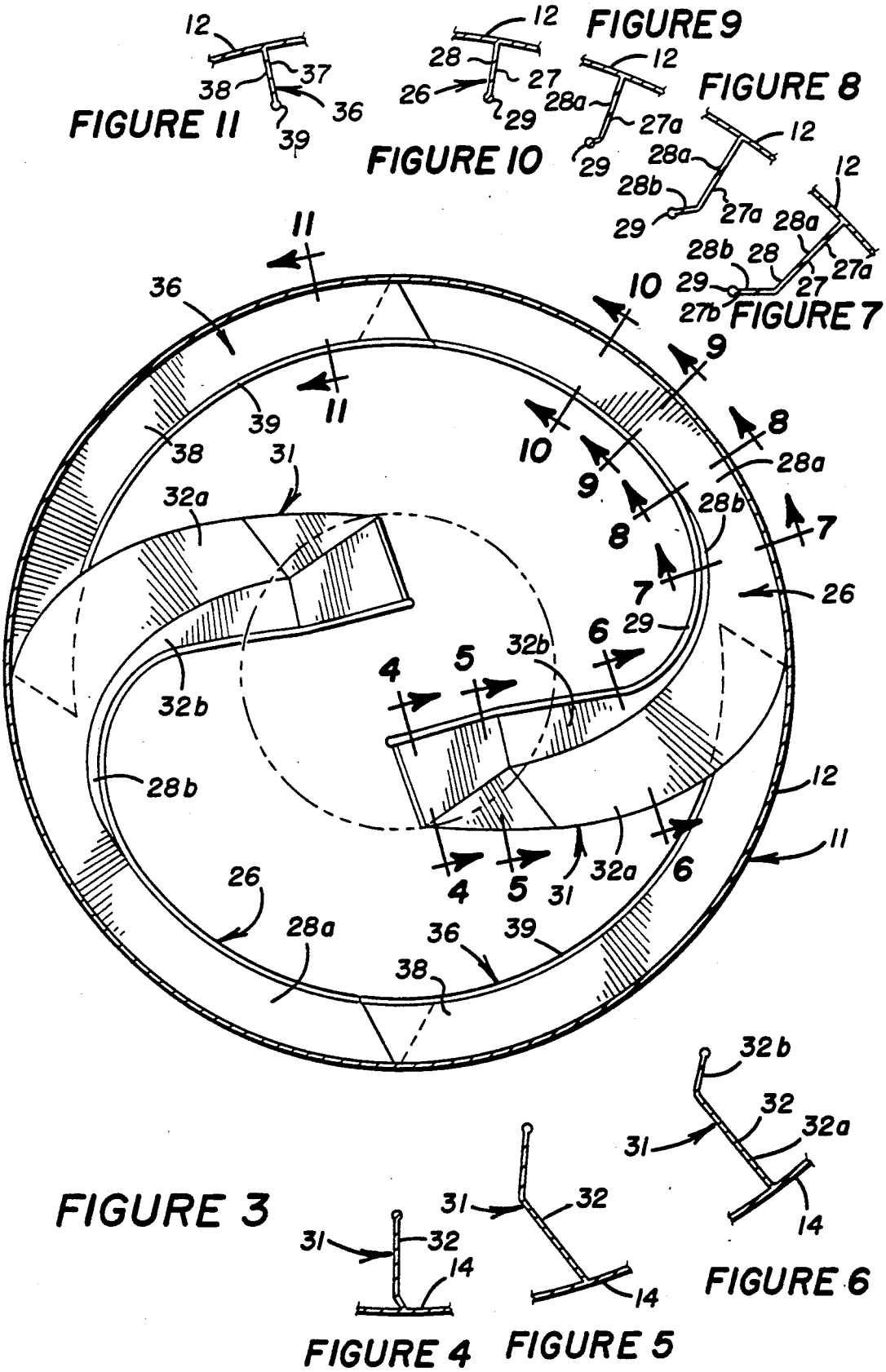
FIG. 3 is an end view of the tumble mixer, as seen from the line 3—3 of FIG. 2, and with the frusto-conical ends removed to show the shape and relative locations of the internal vanes.
FIGS. 4—10 are sectional views of the two discharge troughs and primary vanes, at intervals along the length thereof, as seen from lines 4—4 through 10—10, respectively, of either FIGS. 2 or 3.
FIG. 11 is a sectional view of one of the two secondary vanes, as seen from lines 11—11 of either FIG. 2 or FIG. 3.

Referring now to the drawings, wherein preferred embodiments of the invention is illustrated, and in particular to FIGS. 1–11, the vacuum tumble mixer 10 comprises a drum 11 having a cylindrical mid-section 12 and frusto-conical or dished entry and discharge end sections 13 and 14. These ends have axial entry and discharge openings 16 and 17, respectively, which openings may be closed and sealed by doors 18 so that the interior of the drum can hold a vacuum. The drum 11 rests on two elongated and horizontal rollers 19 with the axis of the drum being horizontal. The rollers 19 are mounted in frame members 20, and at least one roller 19 is reversibly driven by motor 21 to rotate the drum 11 in either direction about its horizontal axis. As is more fully brought out below, rotation of drum 11 in clockwise direction, as viewed in FIGS. 1 and 3, is tumbling rotation, while counterclockwise rotation is discharge rotation.

A pair of relatively thin primary vanes 26, of uniform thickness, is secured to the interior surface of the cylindrical mid-section 12, the vanes 26 being spaced 180 from each other around the drum and extending helically from the entry end section 13 to the discharge end section 14. Each primary vane 26 has opposed tumbling and discharge surfaces 27 and 28, respectively, thereon facing in the directions, respectively, of the entry and discharge ends 13 and 14 of the drum.

The tumbling and discharge surfaces 27 and 28 each have along the full length thereof radial portions 27*a* and 28*a*, extending from the mid-section of the drum towards the drum axis. From about midway of the length of the mid-section 12 of the drum to the discharge end 14, the inner part of the primary vanes 26 are bent and inclined at a 45° angle in the direction of discharge rotation, to form inclined portions 27*b* and 28*b* of the tumbling and discharge surfaces 27 and 28.

An enlarged bead 29 is formed on the inner edges of the primary vanes 26 and along the length thereof to protect the product in the drum from being cut by the vanes as they rotate during tumbling and discharge.

The primary vanes 26 blend smoothly into the discharge troughs 31 which are secured to the interior of the discharge end 14 of drum 11, and extend generally helically to the discharge opening 17. Each discharge trough 31 has a channel-shaped discharge surface 32 with radial and inclined surfaces 32*a* and 32*b* which are formed to provide smooth continuation of the radial and inclined discharge surfaces 28*a* and 28*b*, respectively, of the vanes 26.

As seen from the sectional views of the primary vanes 26, FIGS. 7–10, the radial discharge surface 28*a* and the inclined discharge surface 28*b* become progressively higher towards the discharge end of the drum so that the channel formed by these surfaces becomes progressively larger to match the capacity of the discharge trough 31.

For smaller drums, a pair of primary vanes 26 will be adequate to provide the desired tumbling and discharge.

For larger drums, such as disclosed herein, one or more pairs of relatively thin secondary vanes 36, again of uniform thickness, are secured helically to the interior surface of the cylindrical mid-section 12, with the vanes extending from the entry end section 13 to the discharge end section 14, the vanes 36 being spaced 180° around the drum from each other and 90° around the drum from vanes 26. Each secondary vane 36 is of constant height throughout its length and has opposed radially directed tumbling and discharge surfaces 37 and 38, respectively, thereon facing in the respective directions of the entry and discharge ends 13 and 14 of the drum. The secondary Vanes 36 also have enlarged beads 39 along their inner edges throughout their length.

The primary and secondary vanes 26 and 36 preferably have a pitch approximately equal to three to four times the diameter of the mid-section 12 of drum 2. For example, with a drum having a cylindrical mid-section 12 which is 46 inches in diameter and 36 inches in length, and with the vanes having a pitch of 3.13 times the diameter, the entry and discharge ends of the vanes will be approximately same 90° apart around the drum. With this pitch, the angle of the vanes to the axis of the drum is shallow enough to produce an excellent pressure-pulsing massage, and yet adequate to cause the product to mix effectively from end-to-end or to be conveyed to the discharge end of the drum.

The discharge troughs 31 also have a pitch approximately the same as that of the primary vanes 26. Thus, when the product reaches the discharge troughs it will be discharged from the drum in a quarter rotation of the drum.

The primary vanes 26, from their entry ends 13 to midway of the mid-section 12, and the secondary vanes 36 typically have a height approximately 7.5% of the diameter of the mid-section of the drum. However, vane height is a variable which will depend on the characteristics of the product being processed. Higher vanes will increase the massaging action, but may be harmful to delicate products. Also, if exceptionally viscous or dense products are being processed, more power may be required to turn the drum that can be supplied.

In operation, the ingredients to be processed, e.g. meat or poultry, water and seasonings, are loaded into the drum from either, or both, end openings 16 and 17 as desired. The doors are closed and sealed, and the air is extracted by vacuum pumps (not shown).

In the tumble phase, the tumbling surfaces 27 and 37 of vanes 26 and 36 repeatedly press against the product, lift it up and allow it to flow over the vanes, to produce the desired pressurization and de-pressurization massage cycles. At the same time the tumbling surfaces 27 and 37 act as internal screw flights to convey the product around the interior of the drum gently towards the entry end 13 of the drum. Such movement will cause the product to mound up at the entry end so that the upper part of the product in the drum will move away from the entry end and towards the discharge end. Such circulating movement of the product lengthwise of the drum will cause good end-to-end mixing of the product.

When the tumbling process is complete the vacuum is released, the discharge door 18 is opened, and the drum is rotated in the opposite, or discharge direction. All vanes now engage the product with their discharge surfaces to convey the product towards the discharge end 14. As the product is so conveyed, it is picked up by the channel shaped portions of vanes 26 and slides along these vanes directly into the discharge troughs 31. The two discharge troughs 31 provide a constant flow of the product from the drum, and the drum will completely empty in about three revolutions, more or less, depending on the capacity of the drum.

It has been found that the above described vane system does such a good job of mixing the product that it is possible to add $CO_2$ snow into the product in the tumble mixer 10, after the vacuum tumbling has been substantially or fully completed and before the discharge of the product from the drum. The mixing and chilling of the product in the drum is so gentle that the previously mentioned meat fiber damage during chilling is substantially eliminated.

Figure 12:
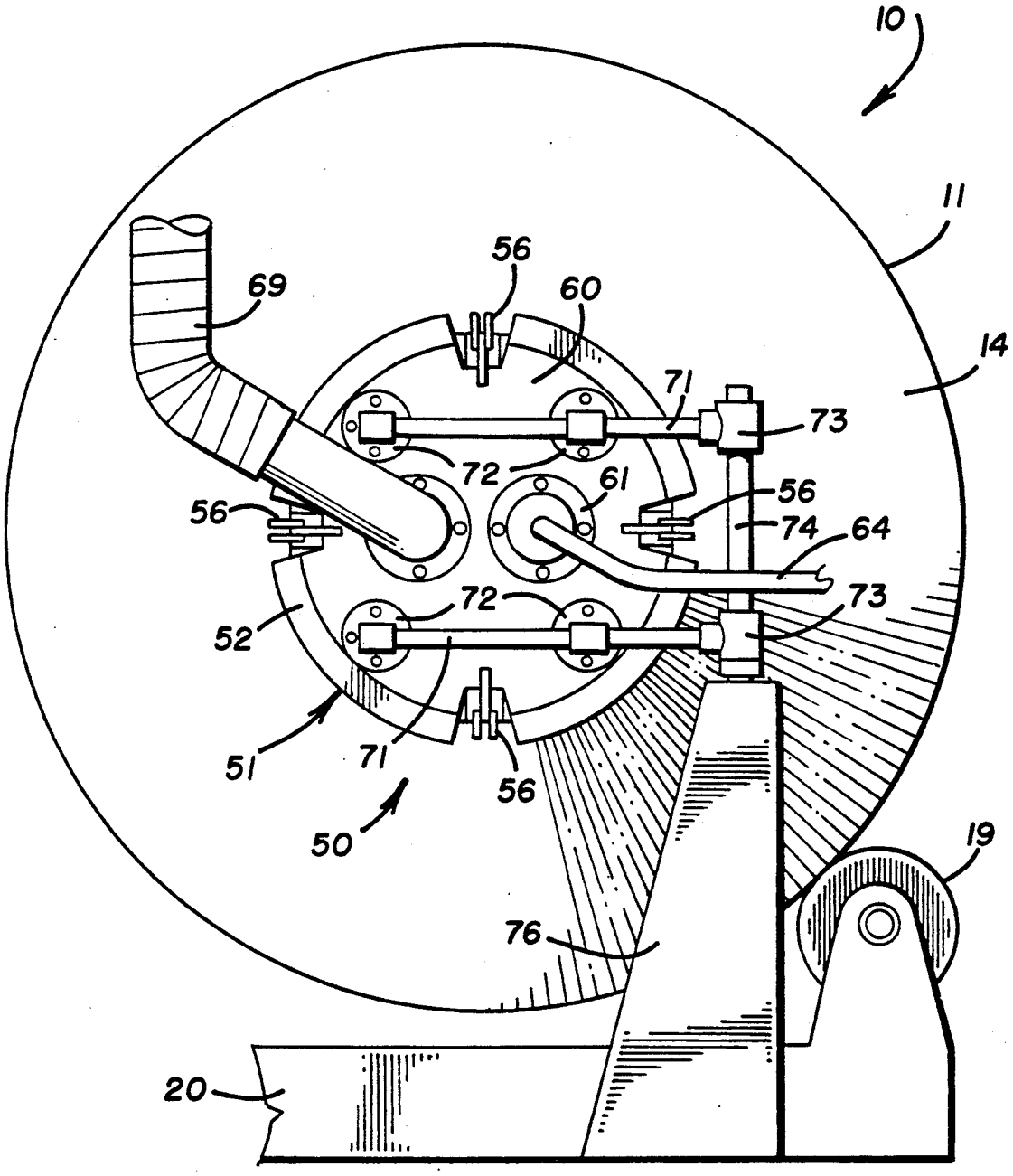
FIG. 12 is an end view of another embodiment of the tumble mixer of FIG. 1, illustrating a $CO_2$ snowhorn system for the tumble mixer.
Figures 13, 14:
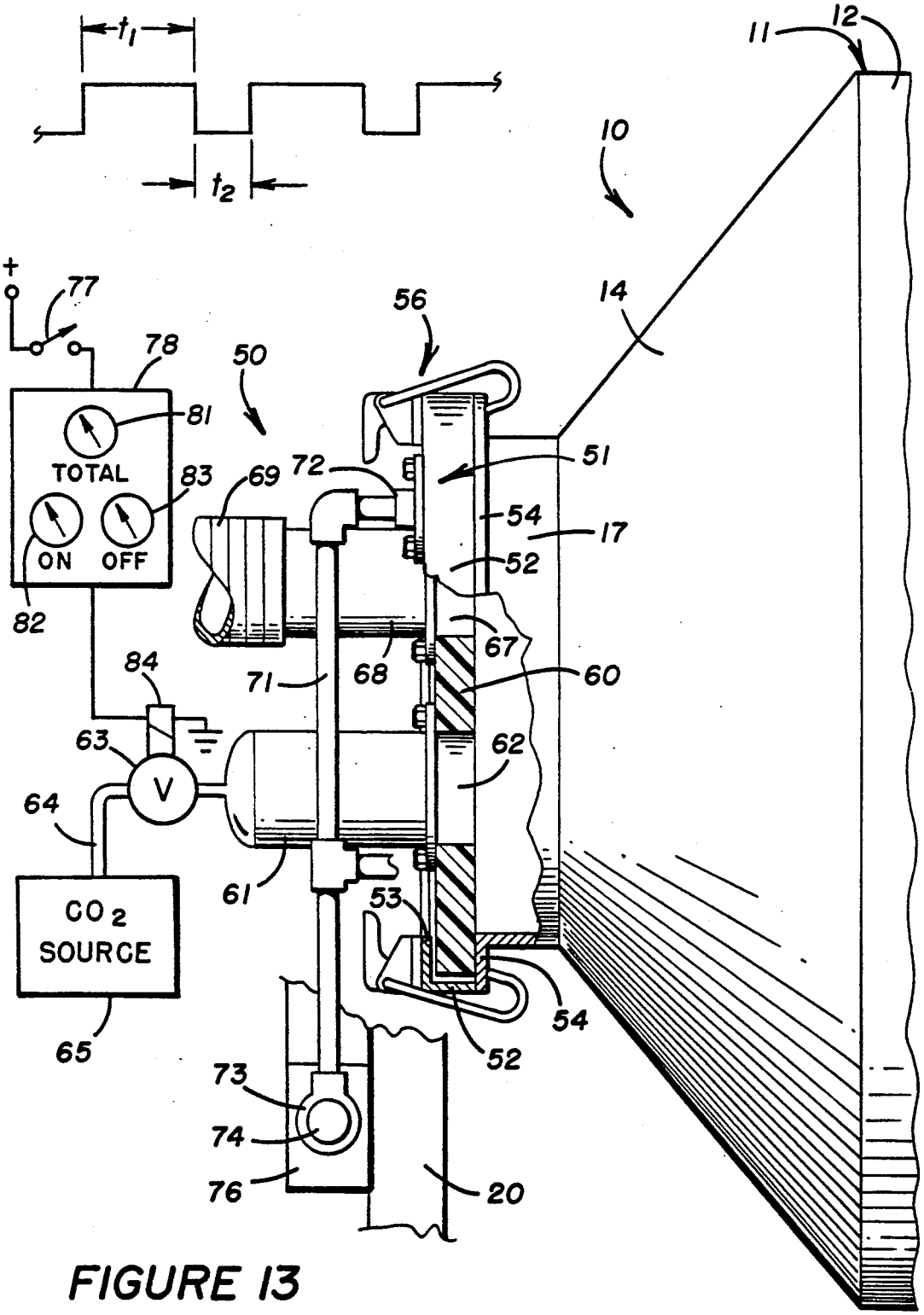
FIG. 13 is a plan view of a portion of the $CO_2$ snow horn system and embodiment of FIG. 12.
FIG. 14 is a timing chart of the on-and-off bursts of $CO_2$ snow production.

FIGS. 12 and 13 illustrate a chilling system 50 usable with the previously described tumble mixer 10. A ring 51, having an annular flange 52 and an inwardly extending flange 53, is adapted to seat on drum flange 54 surrounding one of the end openings into the drum, with the ring 51 being clamped securely to the drum flange by overcenter clamps 56. Although the chilling system 50 is shown as associated with the discharge end 14 of the drum, it could be mounted at the other end, if desired.

A circular plate 60 has its rim disposed in the channel formed by ring flanges 52 and 5 and drum flange 54, the plate being and is preferably made of a suitable plastic material, such as delrin, having a low coefficient of friction with the materials of ring 51 and the drum flange 54. One or more conventional $CO_2$ snow horns 61 are mounted on plate 60 so that the interior of the snowhorn 61 opens through plate opening 62 into the interior of drum 11. The snowhorn 61 is connected through valve 63 and flexible hose 64 to a source 65 of liquid carbon dioxide.

The interior of the drum is vented through plate opening 67, vent tube 68 and a flexible vent hose 69.

The plate 60 is supported by horizontal tubes 71 secured to the plate by fittings 72, and secured by annular fittings 73 to the vertical shaft 74 extending upwardly from frame member 76. The annular fittings 73 are rotatable on shaft 74 so that the plate 60 and ring 51 can be swung horizontally towards and away from the drum opening.

In operation as a vacuum tumble mixer, the plate 60 of the chilling system 50 is swung out of the way and the drum is closed by the vacuum doors 18. After the previously described vacuum tumbling process is complete, the drum 11 is stopped, and the door 18 is either removed, or swung to a position adjacent the end of the drum where it will not be in the way of the chilling system apparatus. Plate 60 and ring 51 are then swung into position and ring 51 is clamped to the drum flange 54 by clamps 56.

The drum 11 can now be rotated with the plate 60 being held stationary. Switch 77 is then closed to start timer 78 into operation. Timer 78 may be of any conventional form, and preferably with a manual control 81 to set the total length of time that $CO_2$ snow is to be generated to chill the product, and with manual controls 82 and 83 to set the predetermined on-time $t_1$ and off-time $t_2$ (FIG. 14) for each cycle $(t+t_2)$ of $CO_2$ snow production. Thus, solenoid 84 will be energized to open valve 63 for flow of liquid $CO_2$ to snowhorn 61 for $t_1$ time in each cycle, with such flow being shut off for $t_2$ time before the next flow of liquid $CO_2$ to the snowhorn. This cycle will repeat until the end of the time for which control 81 has been set. Liquid $CO_2$ from valve 63 is injected into the snow horn 61 which causes the liquid $CO_2$ to swirl and change into a snowlike solid. The $CO_2$ snow mixes with the tumbling product in drum 11 as the drum rotates. The previously described vane system provides an excellent end-to-end mixing of the $CO_2$ snow with the product, which is important to provide uniform chilling throughout the produce and at the same rate. As the $CO_2$ snow sublimates during the chilling process, the gas is removed through the vent tube 68 and hose 69.

After chilling, the drum is stopped, the ring 51 is unclamped, and the plate 60 and ring 51 are swung away from the drum opening. The chilled product in the drum may now be discharged by reverse rotation of the drum as previously described. If the chilling system 50 is associated with the entry end 13 of the drum 11, discharge of the product can be effected with the chilling system attached to the drum, if desired.

The chilling system is designed for the particular snowhorn used so that the rate of flow of liquid $CO_2$ to the snowhorn, when valve 63 is open, will produce the most efficient generation of $CO_2$ snow. The repeated opening and closing of valve 63 does not change the rate of flow of liquid $CO_2$ to the snowhorn when the valve is open, and does not change the efficiency of generation of each of the repeated bursts of snow. By adjustment of the on-and-off times $t_1$ and $t_2$, the total amount of $CO_2$ snow produced in the chilling operation can be easily varied to match the rate at which the $CO_2$ snow can be mixed with the product, without decreasing the efficiency of $CO_2$ snow generation.

A typical cycle of on-and-off times in a vacuum tumble mixer with a 2,000 pound capacity, while chilling whole muscle chicken meat is thirty seconds on and three seconds off. In this case, the product will be chilled in the same total time (seven minutes) as if the snowhorn system were run continuously, but the consumption of liquid $CO_2$ will be ten percent less. The current cost of $CO_2$ liquid is about four cents a pound. In the example just given, the $CO_2$ snowhorn system will use liquid $CO_2$ at a rate of 200 pounds per minute when run in a continuous mode. Such a rate of usage would cost eight dollars per minute, or $56 for a batch with seven minutes of chilling. A ten percent reduction in cost per batch would then be $5.60. On a two-shift per day, six days a week basis, the savings would be almost $56,000 per year per drum tumbler.

For most drum tumbler mixing machines with a snowhorn chilling system, the cycles of on-and-off times for the bursts of $CO_2$ snow will range from five seconds on and ten seconds off to sixty seconds on and two seconds off.

Figure 15:
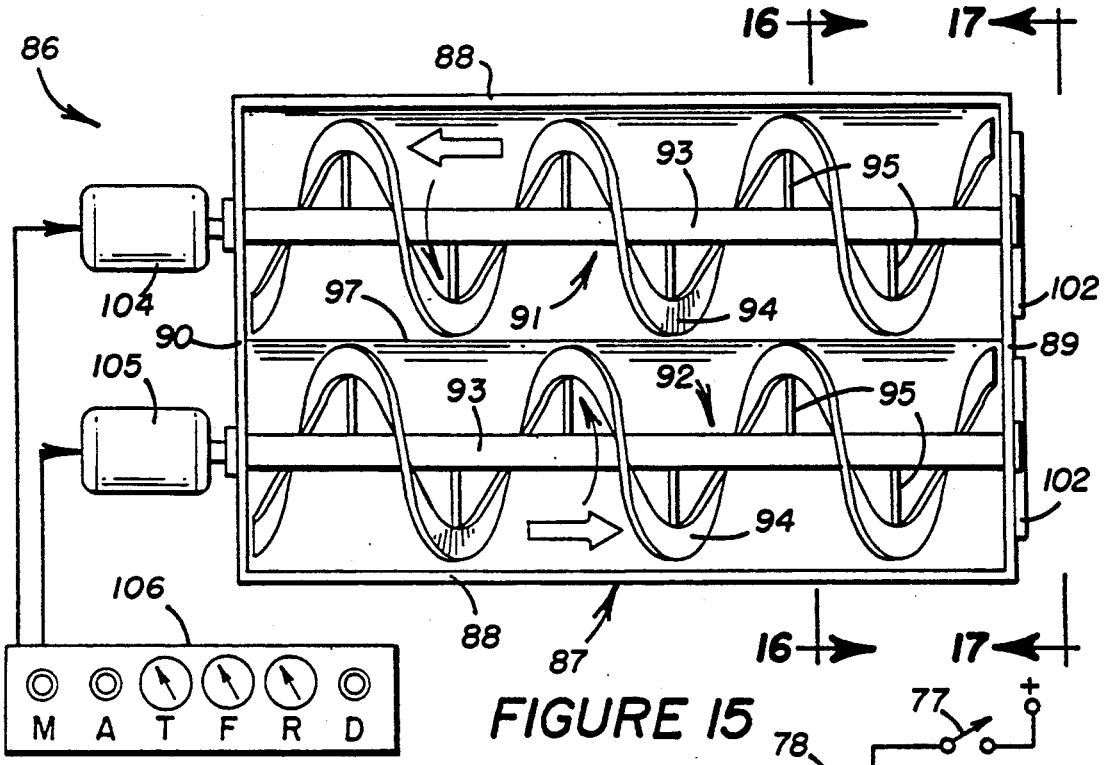
FIG. 15 is a simplified view, in plan, with cover removed, of a twin horizontal agitator blender form of a mixing machine.
Figure 16:
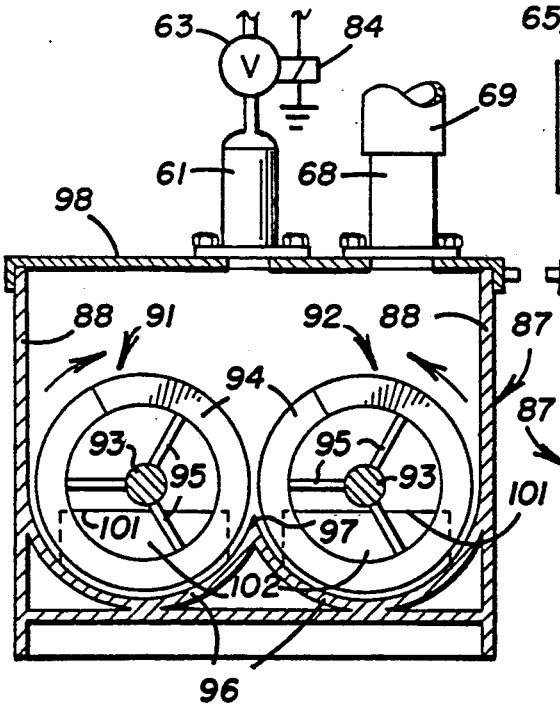
FIGS. 16 and 17 are elevation views of the blender of FIG. 14, taken on lines and 16—16 and 17—17 thereof, and illustrating a $CO_2$ snowhorn system for the mixing machine.
Figure 17:
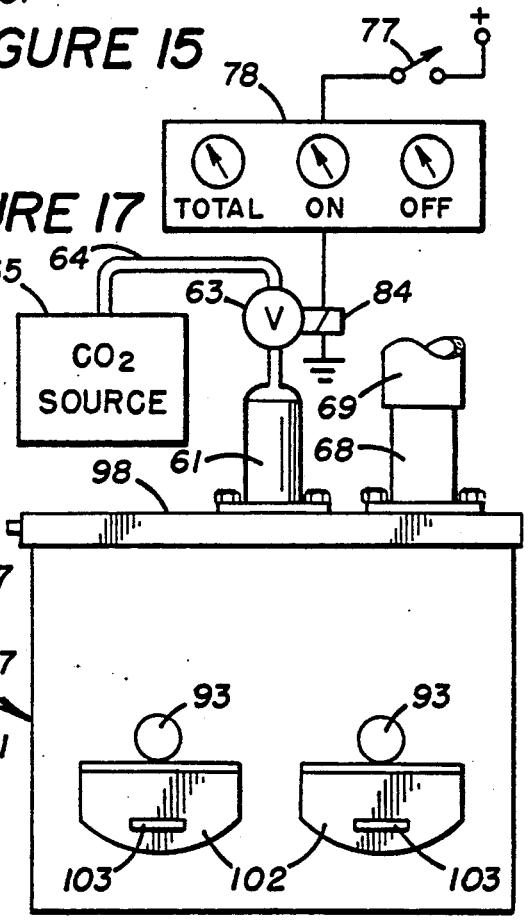

FIGS. 15–17 illustrate the use of the present improved $CO_2$ snowhorn chilling system with a mixing machine 86 of the twin agitator blender type. The blender comprises a tub 87 having two side walls 88, a discharge wall 89 and an opposite end wall 90, and two horizontal and parallel agitators 91 and 92 extending from end-to-end of the tub. Each agitator has a horizontal shaft 93 and a spiral ribbon 94 of steel supported on the shaft by radially extending spokes 95. As seen in FIG. 16, the bottom of the tub 87 is formed as two circular arcuate troughs 96 meeting in a cusp 97, the troughs having radii slightly greater than the outer radii of the agitator ribbons 94. A top cover 98 encloses the blender.

The discharge end wall has discharge openings 101 which are closed during blending operation by doors 102. The doors are hinged to end wall 89 and provided with handles 103 or the like so that they may open the tub for discharge after blending and chilling.

Agitators 91 and 92 are rotated by motors 104 and 105 which are suitably coupled to the agitator shafts 93. A control box 106 is electrically connected to the motors, and typically may have manual and automatic start-stop switches M and A, a timer T to control the total length of a blending operation, timers F and R to control the length of forward rotation and reverse rotation of the agitator 91 and 92 in a cycle of operation, and a discharge switch D.

Merely by way of illustration, a blender with a 2,000 pound capacity will have a tub with a length of 72 inches, a width of 46.5 inches and a height of 36 inches. The ribbons 94 will be wound as right hand spirals, with a diameter of 23 inches and a pitch of 21 inches. The agitators will typically be driven at about 45 rpm., but the speed may vary therefrom depending on the nature of the product being blended.

The blender 86 is equipped with a conventional $CO_2$ snowhorn 61 connected through valve 63 to a source 65 of liquid $CO_2$ The solenoid 84 of valve 65 is controlled by timer 78 in a manner as previously described in connection with FIGS. 13 and 14. Depending on the size of the blender 86, one or more snowhorns may be used, with one valve 63 controlling flow of liquid $CO_2$ to each snowhorn, or with a separate valve 63 for each snowhorn, the valves being all operated on and off in unison.

In operation, the ingredients to be mixed or blended will be put into the tub, and the agitators 91 and 92 are started into operation. The agitator shafts are rotated in opposite directions, and when rotated in the directions indicated on FIGS. 15 and 16 the products will be moved in the troughs in the direction as indicated by the large flow-direction arrows in FIG. 15. The counter rotating agitators fold the products to the center of the tub, and along the length thereof, to cause the products in each trough to mix with the others.

When it is desired to chill the product, switch 77 is closed to start timer 78 which will repeatedly energize solenoid 84 for a $t_1$ time and de-energize the solenoid for a $t_2$ time so that repeated bursts of $CO_2$ snow will be produced at maximum efficiency and injected into the tub. The continued operation of the agitators will mix the $CO_2$ snow into the product. As the $CO_2$ snow sublimates during the chilling process, the gas is removed through vent tube 68 and hose 69.

As before the on-and-off timer for the bursts of snow are chosen to match the production of $CO_2$ snow to the mixing efficiency of the blenders so that the maximum amount of generated $CO_2$ snow is mixed into the product. Also, as before, the on-and-off times for the bursts of $CO_2$ snow will range from five seconds on and ten seconds off to sixty seconds on and two seconds off.

After the chilling operation, the discharge switch D is actuated. This will cause motors 104 and 105 to rotate both agitators 91 and 92 in the same direction so that they will both urge the product towards the discharge end of the tub. The discharge doors 102 are opened and the blended and chilled product is discharged through openings 101 to suitable containers or conveyors.

The foregoing description of the preferred embodiments have been presented for purposes of illustration and description. It is not intended to be exhaustive or to limit the invention to the precise form described, and obviously many other modifications are possible in light of the above teaching. The embodiments were chosen in order to explain most clearly the principles of the invention and its practical applications thereby to enable others in the art to utilize most effectively the invention in various other embodiments and with various other modifications as may be suited to the particular use contemplated. It is intended that the scope of the invention be defined by the claims appended thereto.

I claim:

1. A tumble mixer comprising:

a rotatable drum having a horizontal axis, a cylindrical mid-section with an interior surface, and entry and discharge end sections at least said discharge end section having an axial opening, means for rotating said drum about its axis alternatively in a tumbling direction or oppositely in a discharge direction, a plurality of relatively thin primary vanes secured helically to the interior surface of said drum, said primary vanes being spaced equidistantly apart from each other and extending along said cylindrical mid-section from one end section to the other, each of said primary vanes having opposed tumbling and discharge surfaces thereon respectively facing towards said entry and discharge ends of said drum, said tumbling and discharge surfaces each having a portion extending inwardly from the interior surface of said drum generally towards the horizontal axis of said drum and with the amount of inward extension of said tumbling and discharge surfaces from said interior surface of said drum increasing progressively towards said discharge end of said drum from a point which is intermediate the length of said vane and between said entry and discharge ends of said drum, a plurality of discharge troughs secured helically to the interior of said discharge end of said drum at locations spaced equidistantly apart from each other, each of said troughs having a channel-shaped discharge surface facing towards said discharge opening, said discharge surfaces being formed as smooth continuations of the discharge surfaces of said primary vanes.

2. A tumble mixer as set forth in claim 1 wherein said primary vanes each has an enlarged bead formed on the inner edge thereof and along the length thereof.

3. A tumble mixer as set forth in claim 1 wherein said primary vanes have a helical pitch of approximately 3 to 4 times the diameter of said mid-section of said drum.

4. A tumble mixer as set forth in claim 3 wherein said discharge troughs each have a helical pitch the same as that of said primary vanes.

5. A tumbler mixer as set forth in claim 1, and further including a chilling system associated with an axial opening in one of said end sections of said drum, said chilling system having:

a carbon-dioxide snowhorn, means for removably mounting said snowhorn on said drum to discharge carbon-dioxide snow into said drum, means for supplying liquid carbon-dioxide to said snowhorn.

6. A tumble mixer as set forth in claim 5, wherein said means for supplying liquid carbon-dioxide to said snowhorn includes means for supplying said carbon-dioxide to said snowhorn in repeated cycles, with said liquid carbon-dioxide being supplied to said snowhorn for a predetermined portion of each cycle and with said supply being cut off for the remainder of each cycle.

7. A tumble mixer as set forth in claim 1, and further including a chilling system associated with an axial opening in one of said end sections of said drum, said chilling system having:

a circular plate, means for holding said plate stationary adjacent said axial opening to close said axial opening and for permitting said drum to rotate about its axis while said plate is held stationary, a carbon-dioxide snow horn mounted on said plate and positioned to discharge carbon-dioxide snow through said axial opening and into said drum, means for supplying liquid carbon-dioxide to said snow horn.

8. A tumble mixer as set forth in claim 7, wherein said means for supplying liquid carbon-dioxide to said to said snowhorn in repeated cycles, with said liquid carbon-dioxide being supplied to said snowhorn for a predetermined portion of each cycle and with said supply being cut off for the remainder of each cycle.

9. A tumble mixer as set forth in claim 1 and further including:

a plurality of relatively thin secondary vanes secured helically to the interior surface of said drum, said secondary vanes being spaced equidistantly apart from each other and equally spaced from the other vanes in said drum, said secondary vanes each extending along said cylindrical mid-section of said drum from one end section to the other and having opposed tumbling and discharge surfaces thereon respectively facing towards said entry and discharge ends of said drum, said tumbling and discharge surfaces each extending radially inwardly from the interior surface of said drum towards the axis of said drum with the amount of inward extension of said secondary vanes being approximately the same along the length thereof.

10. A tumble mixer as set forth in claim 9, and further including a chilling system associated with an axial opening in one of said end sections of said drum, said chilling system having:

a carbon-dioxide snowhorn, means for removably mounting said snowhorn on said drum to discharge carbon-dioxide snow through said axial opening and into said drum, means for supplying liquid carbon-dioxide to said snowhorn.

11. A tumble mixer as set forth in claim 10, wherein said means for supplying liquid carbon-dioxide to said snowhorn includes means for supplying said carbon-dioxide to said snowhorn in repeated cycles, with said liquid carbon-dioxide being supplied to said snowhorn for a predetermined portion of each cycle and with said supply being cut off for the remainder of each cycle.

12. A tumble mixer as set forth in claim 9, and further including a chilling system associated with an axial opening in one of said end sections of said drum, said chilling system having:

a circular plate, means for holding said plate stationary adjacent said axial opening to close said axial opening and for permitting said drum to rotate about its axis while said plate is held stationary, a carbon-dioxide snowhorn mounted on said plate and positioned to discharge carbon-dioxide snow through said axial opening and into said drum, means for supplying liquid carbon-dioxide to said snowhorn.

13. A tumble mixer as set forth in claim 12, wherein said means for supplying liquid carbon-dioxide to said snowhorn includes means for supplying said carbon-dioxide to said snowhorn in repeated cycles, with said liquid carbon-dioxide being supplied to said snowhorn for a predetermined portion of each cycle and with said supply being cut off for the remainder of each cycle.

* * * * *